United States Patent [19]

Borse

[11] Patent Number: 4,805,586

[45] Date of Patent: Feb. 21, 1989

[54] DRESSING TOOL FOR GRINDING WHEELS

[75] Inventor: Dietrich Borse, Hamburg, Fed. Rep. of Germany

[73] Assignee: Ernst Winter & Sohn (GmbH & Co.), Hamburg, Fed. Rep. of Germany

[21] Appl. No.: 79,835

[22] Filed: Jul. 30, 1987

[30] Foreign Application Priority Data

Jul. 30, 1986 [DE] Fed. Rep. of Germany ..... 3625754
Mar. 4, 1987 [DE] Fed. Rep. of Germany ..... 3706868

[51] Int. Cl.[4] ..... B24B 53/00

[52] U.S. Cl. ..... 125/11 R; 125/39; 51/204; 51/293; 76/DIG. 12

[58] Field of Search ..... 125/11 R, 38, 39; 76/101 R, DIG. 6, DIG. 11, DIG. 12; 51/204, 293, 308, 309

[56] References Cited

U.S. PATENT DOCUMENTS

| | | | |
|---|---|---|---|
| 2,716,404 | 8/1955 | Taeyaerts | 125/39 X |
| 3,288,580 | 11/1966 | Curn | 51/204 X |
| 3,369,283 | 2/1968 | Colding | 76/101 R X |
| 3,553,905 | 1/1971 | Lemelson | 125/15 X |
| 3,596,649 | 8/1971 | Olivieri | 125/11 R |
| 3,894,673 | 7/1975 | Lowder et al. | 76/DIG. 12 X |
| 4,407,263 | 10/1983 | Murata | 125/15 |
| 4,505,721 | 3/1985 | Almond et al. | 51/309 |
| 4,629,373 | 12/1986 | Hall | 51/309 X |
| 4,671,021 | 6/1987 | Takahashi et al. | 51/293 X |

FOREIGN PATENT DOCUMENTS

| | | | |
|---|---|---|---|
| 2053125 | 5/1972 | Fed. Rep. of Germany | 125/39 |
| 0129589 | 10/1979 | Japan | 51/206 R |
| 0856047 | 12/1960 | United Kingdom | 51/204 |
| 2038214 | 7/1980 | United Kingdom | 51/204 |

*Primary Examiner*—Robert P. Olszewski
*Assistant Examiner*—Shirish Desai
*Attorney, Agent, or Firm*—Michael J. Striker

[57] ABSTRACT

A dressing tool for grinding wheels includes a base body and a diamond coat which is formed of diamond grains embedded in a metallic bond. The diamond grains are artificially roughened so that their surface area is significantly enlarged and are arranged in the metallic bond with such density that the majority of grains are in direct contact with adjacent grains.

22 Claims, 3 Drawing Sheets

DRESSING TOOL FOR GRINDING WHEELS

BACKGROUND OF THE INVENTION

The present invention relates to a dressing tool for grinding wheels.

It has been known that dressing is an operation of removing the dull or loaded surface of the grinding wheel.

More particularly, the present invention relates to a dressing tool for grinding wheels which have a diamond coat on a base body and in which diamonds are held in a metallic bond in the coat. Such dressing tools may be cylindrical or profiled or alternatively wheels or dressing slabs.

The dressing operation is normally a mechanical shaping of a rotary grinding wheel, wherein the dressing tool is held against or applied to the working surface of the grinding wheel and producing controlled abrasion on the grinding wheel in such a fashion that the working surface of the grinding wheel will run perfectly true when rotating. A defined profile can be produced on the working surface of the grinding wheel.

The dressing operation is also used to produce a defined effective peak-to-valley height. When a workpiece is ground, the grinding wheel frequently tends to produce a defined roughness on the surface thereof. The degree of this roughness depends on the manner in which the dressing step on the grinding wheel was carried out. The effective peak-to-valley height is affected, on the one hand, by the kinematic dressing conditions, for example the rate of feed of the dressing tool on the grinding wheel surface in the direction of the axis of the grinding wheel. On the other hand, the grain size of the diamonds and the density of the diamond grain arrangement in the dressing tool also have a marked influence on the effective peak-to-valley height of the grinding wheel.

A dressing tool which is of simple construction but is versatile in use usually contains diamonds positioned in a systematic or random arrangement in a plane plate or so-called diamond coat. The diamond coat is joined to a base body which allows fixing to the grinding machine or to a device provided for dressing. Such a design of a dressing tool is termed a dressing slab.

The diamond coat is applied with its edge tangentially to the grinding wheel. Controlled abrasion on the grinding wheel is effected by diamond grains which are located in the region of the edge and are outwardly exposed to the grinding wheel.

In known dressing slabs, diamond grains are arranged in the plate in defined spacings. The diamond grains can lie as a single layer in one plane. Typical diamond grain sizes are between 0.5 mm and 1 mm. In cases where smaller diamond grains are used, they can also be arranged in several layers on top of one another.

During the dressings process of the grinding wheel, the grinding grains of which normally consist of corundum or silicon carbide, wear which occurs on the diamond grains of the dressing tool is relatively small. However, diamond grains must be held firmly by the surrounding metallic bonding material, so that they can adequately withstand the abrasive action of the grinding wheel. The bonding metal in which diamond grains are embedded must therefore also have a fairly high wear resistance. Typical bonding metals are alloys based on tungsten carbide and/or tungsten. If less wear-resistant bonding materials are used, such as, for example, cobalt, nickel or bronze, relatively rapid wear occurs on these metals, so that diamond grains embedded in the bond can break out of the bond at an unduly early stage. In the case of a dressing tool showing unduly rapid wear, however, the problem arises in maintaining precise dimensions during the dressing process, since the dimensions of the dressing tool may already change during the dressing process at predetermined feed rates. Moreover, the economic result of dressing would be unsatisfactory, because the dressing tool would wear out too rapidly, and unduly frequent replacement with a new tool would be necessary.

Diamond grains in the dressing tool are also subject to high thermal stresses due to intense friction on the grinding wheel. Diamond grades of high thermal stability are therefore chosen for such dressing tools. The disadvantage of the use of metal bonding based on tungsten or tungsten carbide resides in that relatively high sintering temperatures in the range of 900° are necessary to produce this bond, so that diamond grains which are to be embedded in the bond suffer a greater or lesser amount of thermal damage on sintering. A process similar to the sintering of metal powder, and likewise conventional, is sintering in combination with impregnation with a liquid metal.

A production method in which the application of high temperatures is unnecessary comprises the use of a metal which can be electro-plated, such as, for example, cobalt, nickel, bronze or copper. However, these metals do not possess a very high abrasion resistance.

Recent studies have shown that the disadvantage of the lower abrasion resistance of these bonding materials which can be electro-plated is less serious if a dense arrangement of diamond grains in the diamond coat is provided. However, it was then found that the metal skeleton remaining between the diamond grains has relatively thin cross-sections and is therefore unable to hold the diamond grains in the best way. In fact, if diamond grains are merely enclosed by the metal in the metallic bonding, an adequately adhering joint between the enclosing metal and the diamond grains is not produced. This applies both to the abovementioned sintered metal bonds or impregnated metal bonds and to the metals which can be electro-plated.

SUMMARY OF THE INVENTION

It is an object of the present invention to provide an improved dressing tool for grinding wheels.

It is another object of the invention to provide a dressing tool for grinding wheels, with which the aforedescribed disadvantages of conventional dressing tools are avoided.

These and other objects of the invention are attained by a dressing tool for grinding wheels, comprising a base body and a diamond coat on said base body, said diamond coat including diamond grains held in a metallic bond, said diamond grains being artificially roughened so that a surface area of said grains is enlarged by a factor of at least two as compared to a natural surface of diamond grains, said diamond grains being arranged in said coat with such a density that the majority of said diamond grains are in direct contact with adjacent diamond grains.

The diamond grains may have pore-like indentations formed by etching with metal.

Such an artificially produced surface topography allows an intimate anchorage of the diamond grains, especially in a metal which can be electro-plated, since the metal is able to penetrate into the additional pores of the surface of the grains, which are preferably provided with undercuts. A preferable characteristic of the topography of the surface is that it has many, relatively narrow indentations, into which the metal can penetrate in a root-like fashion, so that a mechanical joint of higher adhesive strength is produced between the bonding metal and the diamond surface. This can be achieved especially by the method in which the diamond grains are provided with pore-like indentations by etching with a metal.

The combination, according to the invention, of a very dense diamond grain arrangement of diamond grains of enlarged surface area and a special surface topography in an electro-plated metal as the joining and enclosing medium produces a dressing tool of high performance capacity.

The metallic bond may be an electro-plated metal, such as nickel, cobalt or their alloys.

The diamond grains may be arranged in a single layer or a plurality of layers so that the diamond grains of one layer engage between the diamond grains of another layer and being in direct contact with grains lying alongside, below and above said one layer.

The diamond grains may be arranged in at least one layer which is provided with at least one wear protective layer in which diamond grains are held in an electro-plated metal which may be of 0.1 to 1 mm thick and may be of cobalt or nickel.

Said at least one layer may consist of roughened diamond grains of approximately the same size of 500 to 1,000 μm, and said protective layers may each have approximately the same thickness as that of said at least one layer which is located between said protective layers which are composed of diamond grains of a size of up to 100 μm.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
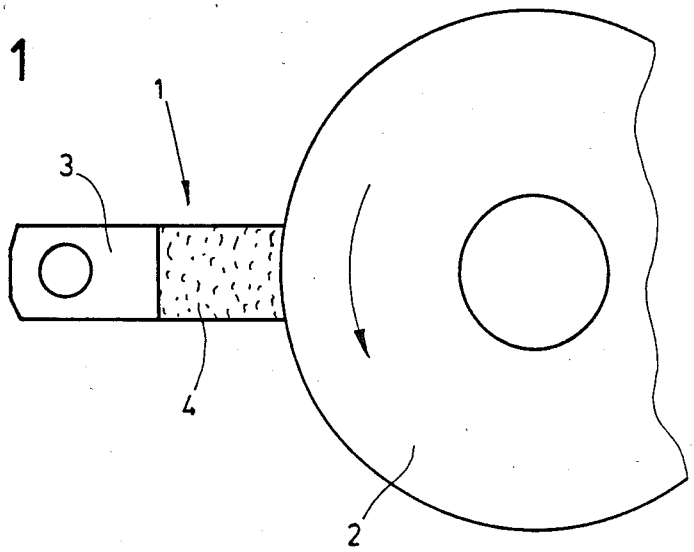
FIG. 1 is a front view of a dressing slab in the working position on a grinding wheel.
Figure 3:
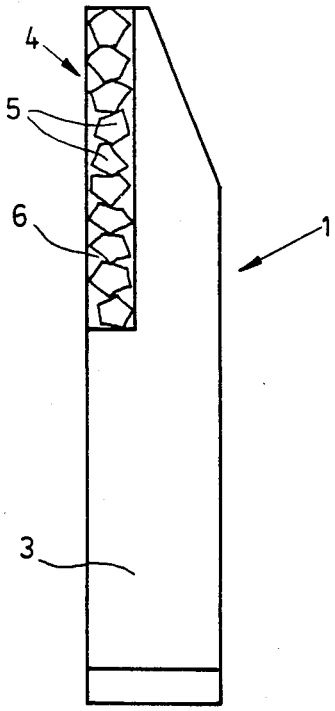
FIG. 3 is a side view of the dressing slab on an enlarged scale.
Figure 2:
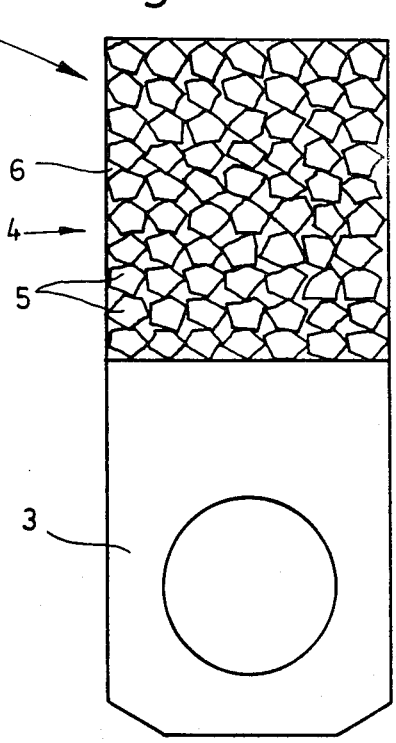
FIG. 2 is a plan view of the dressing slab on an enlarged scale.

Referring now to the drawings in detail, FIGS. 1 to 3 illustrate a dressing tool 1 for a grinding wheel 2. The dressing tool is designed in the preferred embodiment as a dressing slab. The tool 1 is provided with a holder 3 which carries a diamond plate 4. The diamond plate 4 is formed of diamond grains 5 of the same grain size. Diamond grains 5 are arranged in such a way that they are in direct contact with adjacent diamond grains 5. For holding the grains, an electro-plating bond 6 made of nickel or cobalt is provided.

Figure 4:
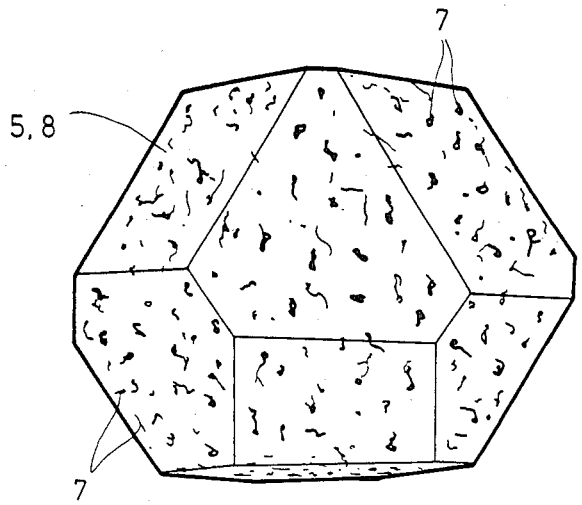
FIG. 4 shows a diamond grain magnified 100 times.
Figure 5:
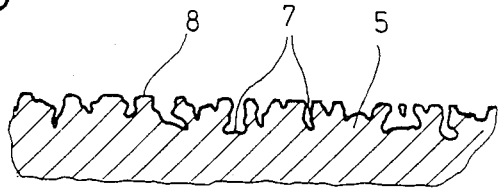
FIG. 5 shows a part detail of the surface of a diamond grain, magnified about 1,000 times.

Individual diamond grains 5, of which one is shown roughened, especially by etching with a metal under the application of heat. As shown in FIG. 4 the surfaces of the individual diamond grain in the shape of a cubic octahedron are provided with numerous pores 7 which have the shape of indentations with undercuts as clearly seen in FIG. 5. As a result, the surface area which is active for holding the diamond grain within the bond is enlarged by a factor of at least two as compared with the natural surface size and, upon electroplating, the metal is able to penetrate in a root-like fashion into the individual pores, so that holding or adhesion is substantially improved. It is thus possible to arrange individual diamond grains in a high concentration when electroplating bonding agents are used, and to enhance the performance capacity of the dressing tool. This applies not only to slab-like dressing tools, but also to dressing tools designed in the form of rolls or wheels.

Figure 6:
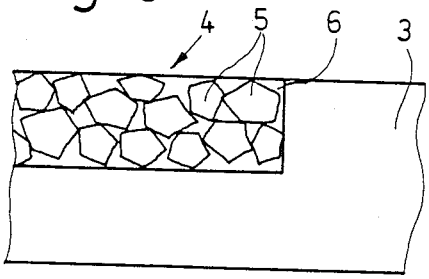
FIG. 6 shows diamond grains in a multi-layer arrangement.

The present invention is not limited to the arrangement of diamond grains in one layer. FIG. 6 shows a further embodiment, in which a multiplicity of diamonds can be arranged in a layerless structure wherein individual diamonds or diamond grains are in contact with diamond grains lying alongside, above as well as below.

Figure 7:
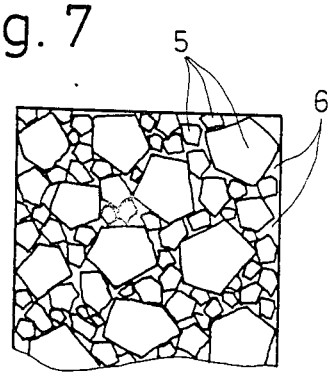
FIG. 7 shows a diamond layer with diamond grains of different grain size.

The use of diamond grain sizes of different orders is possible in accordance with FIG. 7, where small diamonds are located in the gaps between the larger diamonds; this arrangement permits a further increase in the diamond content.

The diamonds utilized in the embodiments described are synthetic diamonds, which are particularly suitable for use in tools according to the invention. However, this does not exclude a use of natural diamonds.

Figure 8:
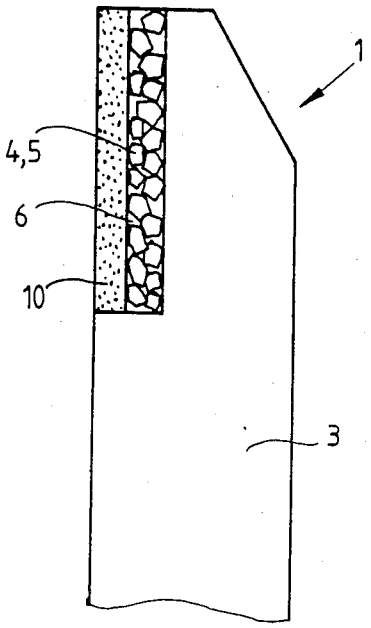
FIG. 8 is a side view of a dressing slab with a wear protection layer on the diamond layer.
Figure 9:
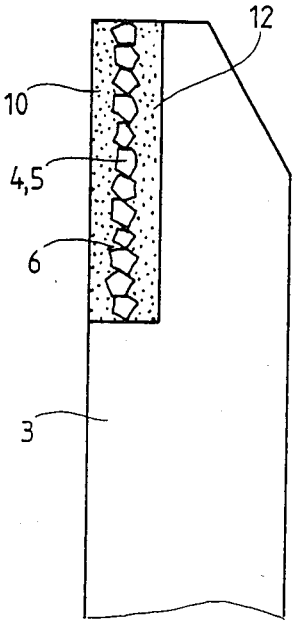
FIG. 9 is a side view of a dressing slab with several wear protection layers.

As shown in FIGS. 8 and 9, one embodiment of the invention provides for the arrangement, on a diamond layer 4, of a wear protection layer 10 which preferably has the thickness of 0.1 to 1 mm and consists of diamonds which are bonded in an electroplating metal such as cobalt or nickel. The surfaces of these diamonds in the wear protection layer 10 are again preferably enlarged by etching.

The provision of protection layers of sintered materials is known from other fields of application. In those cases, the protection layers are produced by powder-metallurgical processes. This involves the disadvantage that, in order to obtain a uniform layer thickness in the outer protection region, the thickness of the protection layer cannot be below a relatively large value, since even thicknesses of 0.8 mm cause problems in powder metallurgy. A further disadvantage of conventional methods is that, in powder-metallurgical production, the diamond concentration has a strict upper limit for process engineering reasons, and a concentration of more than 60 or 2.6 carat/cubic centimeter has not hitherto been feasible in practice. These disadvantages of the powder-metallurgical methods can be avoided by using electroplating, for example the electroplating of metals such as cobalt and nickel. Such electroplating allows a precise limitation of the thickness of the lateral protection layer so that, for example, layer thicknesses of the range of 0.2 to 1 mm can be used. It is then possible, especially for lateral protection to increase the diamond concentration substantially, namely to a concentration of 150 to 200, which is equivalent to 6.6 to 8.8 carat/cubic centimeter. Synthetic diamonds and also natural diamond grains can be used for this, whereby a substantial improvement in the holding of the diamond grains within the electroplated layer is generally obtained when the diamonds show an enlargement of their surface to preferably at least twice its natural size, obtained especially by etching, which would not lead to significant advantages in the case of a bond produced only by powder-metallurgical means. A special advantage here resides in that particularly small grain sizes can be used, which are only about half conventional grain sizes. This ensures extremely firm seating of the superficially pretreated diamonds in an electro-plating bond, so that the utilization level of the expensive diamond material is improved.

If the wear protective layer 10 is provided on the front and back sides of the diamond layer and additionally also on two other sides, the diamond layer 5, 6 is protected against movements in all directions.

Figure 10:
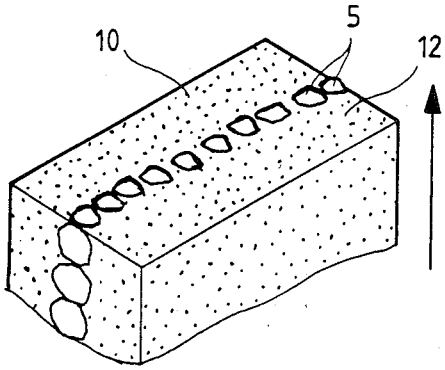
FIG. 10 is a partial perspective view of a dressing slab after a short time in use.

In FIGS. 9 and 10, a dressing slab is illustrated which has diamond grains 5 arranged in one layer. These diamond grains are artificially roughened and bonded in a metal 6 by electro-plating. To protect diamond grains 5, two protective layers 10 and 12 are provided, the thickness of which approximately corresponds to the thickness of the diamond layer 4, 5. The grain size of the diamond grains 5 is about 750 μm. Therefore the protective layers 10 and 12 are also of a corresponding thickness. The protective layers however consist of diamond grains of substantially smaller size, in particular of grains or the order of 70 μm, size, for example.

The additional protective layers 10 and 12 prevent lateral "washing-out" of the bond of the effective diamond grains 5. This results in the advantage that individual diamond grains 5 of the dressing tool can be utilized to a higher degree, because they are firmly retained by the protective layers of the both sides of the diamond layer for a longer period. This is true in particular after a partial consumption of the protective layers according to FIG. 10, that is to say a state in which individual diamonds 5 protrude outwards i the feed direction, corresponding to the arrow, but are protected from lateral breaking-out by the protective layers 10 and 12.

The result of the provision of protective layers 10 and 12 is thus an improvement in the holding of the diamond grains arranged in the middle. The holding is anyway improved over comparable known arrangements by the artificial roughening of their surfaces and their bonding by electro-plating in an arrangement, in which they are in direct mutual contact.

The thickness of the diamond coat effects the precision of a dressing operation. For this reason, dressing slabs with a diamond coat thickness of not more than about 1 mm are particularly suitable. A diamond grain size of for example D 711 is suitable for this purpose.

In the case of multi-layer diamond surfaces, smaller diamond grain sizes, for example D 501, D 301 or D 181, can be used, maintaining the densest grain arrangement possible, in which a large proportion of adjacent diamond grains are in mutual contact.

In further modification of the dressing tools according to the invention, diamond grain mixtures of different grain sizes are used, for example D 711 with D 501 or with D 181 or with D 46 or mixtures of several of these grain sizes, for increasing the density of the diamond grain arrangement.

Three examples A, B and C of different types of dressing slabs are presented below.

Of the three examples, design A corresponds to the known structure, example B shows the results obtained with a slab which has a high diamond proportion of 0.8 carat, but without an artificially enlarged surface as in example C which has the same diamond proportion as design B, but with the surface enlarged according to the invention.

In all cases, the dressing tools are slabs with a coat area of 10 mm × 15 mm and a working edge length of 10 mm, and with a diamond coat of a layer of diamons grains.

The results were obtained when dressing corundum grinding wheels of a diameter D = 500 mm and a width b of 33 mm, the dressing being taken to a diameter of 300 mm. The dressing experiments were continued until 10 mm of the 15 mm deep grinding coat of the dressing slabs had been worn off. The table which follows shows the volumes removed by the dressing from the grinding wheels.

| Designs of Dressing Slabs | A | B | C |
|---|---|---|---|
| Diamond grain size<br>Diamond grade | D 711<br>Original | D 711<br>Original | D 711<br>Special topograph as a result of enlarged surface |
| Diamond content | 0.45 ct | 0.8 ct | 0.8 ct |
| Metal bonding in the diamond coat | Sintered metal | Electro-plated Ni bond | Electro-plated Ni bond |
| Grinding wheel volume removed | 6.5 $dm^3$ | 14.0 $dm^3$ | 21.1 $dm^3$ |
| Specific removal from the grinding wheels, referred to 1 ct of diamond | 14 $dm^3$/ct | 17.5 $dm^3$/ct | 264. $dm^3$/ct |

It will be understood that each of the elements described above, or two or more together, may also find a useful application in other types of dressing tools for grinding wheels differing from the types described above.

While the invention has been illustrated and described as embodied in a dressing tool for grinding wheels, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a dressing tool for grinding wheels, comprising a base body and a diamond coat on said base body, said diamond coat including diamond grains held in a metallic bond, the improvement comprising said diamond grains being artificially roughened so that a surface area of said grains is enlarged by a factor of at least two as compared to a natural surface of diamond grains, said diamond grains being arranged in said coat with such a density that the majority of said diamond grains are in direct contact with adjacent diamond grains.

2. The dressing tool as defined in claim 1, wherein said diamond grains have pore-like indentations.

3. The dressing tool as defined in claim 2, wherein said indentations are formed by etching with metal.

4. The dressing tool as defined in claim 1, wherein said metallic bond is formed of an electro-plated metal.

5. The dressing tool as defined in claim 4, wherein said electro-plated metal is nickel.

6. The dressing tool as defined in claim 4, wherein said electro-plated metal is cobalt.

7. The dressing tool as defined in claim 4, wherein said electro-plated metal is nickel alloy.

8. The dressing tool as defined in claim 4, wherein said electro-plated metal is cobalt alloy.

9. The dressing tool as defined in claim 1, wherein said diamond grains are arranged in a single plane layer.

10. The dressing tool as defined in claim 1, wherein said diamond grains are arranged on top of one another to form a plurality of layers, the diamond grains of one layer engaging between the diamond grains of another layer and being in direct contact with grains lying alongside, below and above said one layer.

11. The dressing tool as defined in claim 1, wherein said diamond grains are of different grain sizes.

12. The dressing tool as defined in claim 1, wherein said diamond grains are synthetic diamonds.

13. The dressing tool as defined in claim 1, which is formed as a dressing slab.

14. The dressing tool as defined in claim 1, wherein said diamond grains are arranged in at least one layer which is provided with at least one wear protective layer in which diamond grains are held in an electroplated metal.

15. The dressing tool as defined in claim 14, wherein said protective layer is of 0.1 to 1 mm thick.

16. The dressing tool as defined in claim 14, wherein said electro-plated metal is cobalt.

17. The dressing tool as defined in claim 14, wherein said electro-plated metal is nickel.

18. The dressing tool as defined in claim 14, wherein surface areas of the diamond grains in the wear protective layer are enlarged by etching.

19. The dressing tool as defined in claim 14, wherein the wear protective layer has a diamond concentration of 5 to 10 carat/cubic centimeter.

20. The dressing tool as defined in claim 14, wherein the wear protective layer is provided on a front side and a back side of said at least one layer.

21. The dressing tool as defined in claim 14, wherein the wear protective layer is provided on four sides of said at least one layer.

22. The dressing tool as defined in claim 14, wherein said at least one layer consists of roughened diamond grains of approximately the same size of 500 to 1,000 μm, and said protective layers each have approximately the same thickness as that of said at least one layer which is located between said protective layers which are composed of diamond grains of a size of up to 100 μm.

* * * * *